United States Patent [19]

Russell

[11] Patent Number: 4,676,306

[45] Date of Patent: Jun. 30, 1987

[54] PRESSURE-CONTROLLED ACCUMULATOR CHARGING VALVE SYSTEM FOR OIL FIELD DOWNHOLE TOOLS

[76] Inventor: Larry R. Russell, 6025 Edgemoor, Suite C, Houston, Tex. 77081

[21] Appl. No.: 791,900

[22] Filed: Oct. 28, 1985

[51] Int. Cl.[4] ..... E21B 43/00

[52] U.S. Cl. ..... 166/319; 166/321; 166/323

[58] Field of Search ..... 166/54, 319, 321, 323, 166/329

[56] References Cited

U.S. PATENT DOCUMENTS 4,415,027 11/1983 Russell ..... 166/321 X

*Primary Examiner*—Stephen J. Novosad

*Assistant Examiner*—Thomas J. Odan

*Attorney, Agent, or Firm*—William A. Knox

[57] ABSTRACT

Apparatus for pressure charging pressure accumulators in apparatus downhole in a well, wherein a first valve system admits pressured fluid into an accumulator from a well tubing such as a drill string in response to well tubing-accumulator differential pressure and a second valve system releases pressured fluid from the accumulator to the well tubing in response to accumulator-well tubing differential pressure. The apparatus utilizes valve assemblies called "fuses", which can be used for accumulator pressure adjustments in lower well tubing pressure ranges and which close in response to higher fluid pressures in the well tubing so that well tubing pressure can be used to do work in the well such as to operate a piston actuator, or the like.

14 Claims, 13 Drawing Figures

PRESSURE-CONTROLLED ACCUMULATOR CHARGING VALVE SYSTEM FOR OIL FIELD DOWNHOLE TOOLS

BACKGROUND OF THE INVENTION

In quite a number of types of equipment used in analyzing and operating oil wells, pressure accumulators are used so that operations may be carried out by utilizing differential pressures between the accumulator and pressures at other points within the equipment. In some equipment, the accumulator pressure is charged with pressured fluid at the surface and remains constant during all periods of use of the equipment. However it is desirable that accumulator pressures be adjustable after the tool has been run downhole and even at intervening times between different uses of the equipment. With the tool down in a well hole several or many thousands of feet below the earth's surface, it is not an easy thing to do to change the accumulator pressure at such a remote location. This invention seeks to provide apparatus and methods for adjusting pressure entrapped in an accumulator so that the accumulator may be used as a pressure reservoir and reference pressure for performing certain functions. In U.S. Pat. No. 4,415,027, an apparatus is disclosed for downhole recharging of accumulators, but the apparatus requires the use of a blanking off wire line tool and multiple valves. Other apparatuses are known in the art for performing accumulator recharging functions, but all suffer from serious defects limiting their utility.

SUMMARY OF THE INVENTION

The invention provides apparatus for charging and recharging pressure accumulators of a tool while the tool is downhole in a well. The apparatus performs in response to fluid pressure in the drill string or production string in the well. The invention will be useful in the operation of tools such as the surface controlled blade stabilizer shown in U.S. Pat. No. 4,407,377, as well as for other tools and apparatuses of somewhat similar nature. The subject apparatus provides a valve system for use in introducing pressure fluid into an accumulator and a separate valve system for use in discharging of pressured fluid from the accumulator, whereby the accumulator may be charged and discharged repeatedly in a controlled fashion to obtain the pressures required for tool operation.

The apparatus according to the invention is operated by pressure within the tubing or other well pipe string passing through a first valve system to the accumulator. Fluid may be discharged from the accumulator through a parallel valve system back into the tubing string. Plural embodiments of the apparatus are disclosed. Use is made in all embodiments of a "fuse" which permits introduction of fluids into the accumulator within certain pressure differential limits, but which shuts off when such pressure limits are exceeded. Therefore, the apparatus may be used with equipment utilizing tubing string pressures for operation of the tool or equipment, and at the same time lower tubing string pressures may be used for accumulator charging and recharging.

A principle object of the invention is to provide accumulator charging and recharging apparatus for use downhole in a well. Another object of the invention is to provide such apparatus which utilizes a pressure "fuse" for controlling accumulator charging procedures. Yet another object of the invention is to provide such apparatus which is reliable and dependable. A further object of the invention is to provide such an apparatus which may be used time and time again while a tool remains downhole in a well. Yet another object of the invention is to provide such an apparatus which is precharged with an inert gas such as nitrogen prior to running into the well. Another object of the invention is to provide such an apparatus which is easy to use and which can be operated by relatively unskilled operators. Yet another object of the invention is to provide such an apparatus which is not charged with excessively high pressures during running thereof into the well and during withdrawal from the well.

Other objects and advantages of the invention will appear from the following detailed descriptions of preferred embodiments, reference being made to the accompanying drawings.

BRIEF DESCRIPTIONS OF THE DRAWINGS

DESCRIPTIONS OF THE PREFERRED EMBODIMENTS

Figure 5:
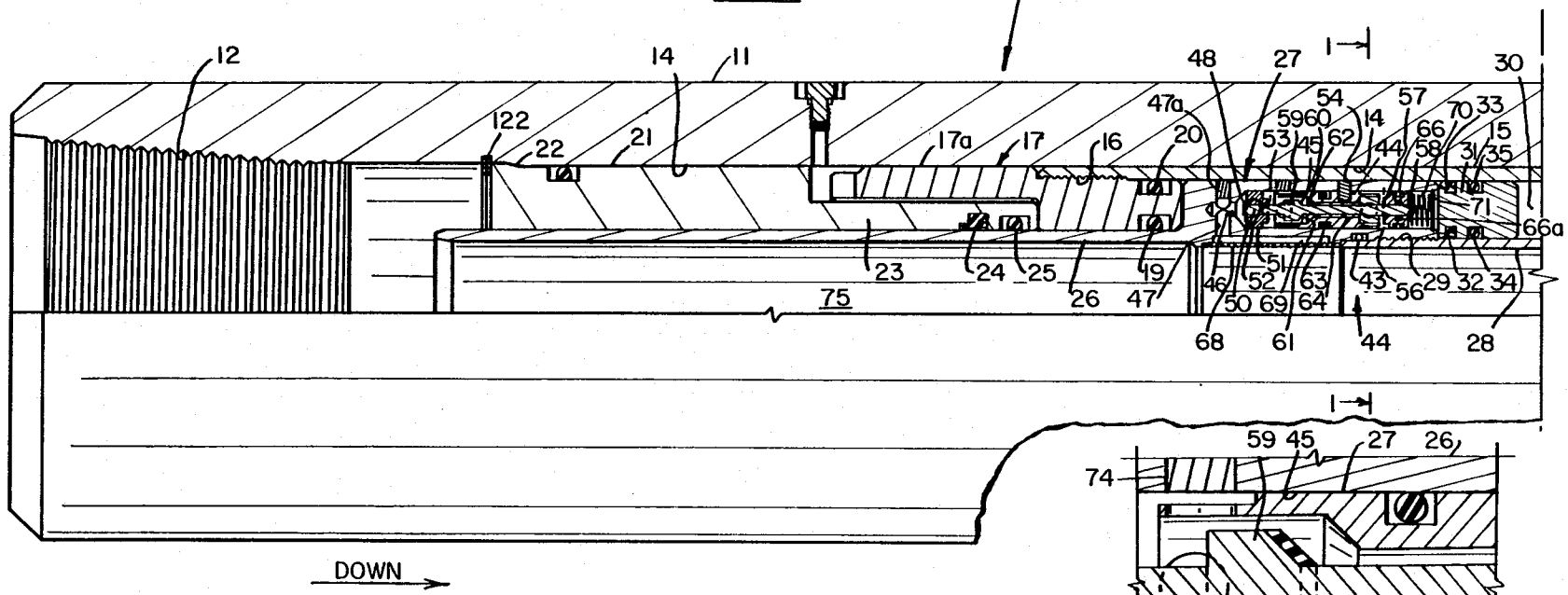
FIG. 5 is a partial quarter section showing the upper end of the apparatus according to the invention.
Figure 5A:
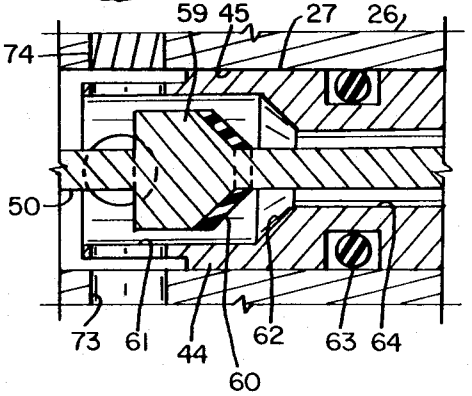
FIG. 5A is an enlarged partial vertical cross section showing a portion of the showing of FIG. 5.
Figure 6:
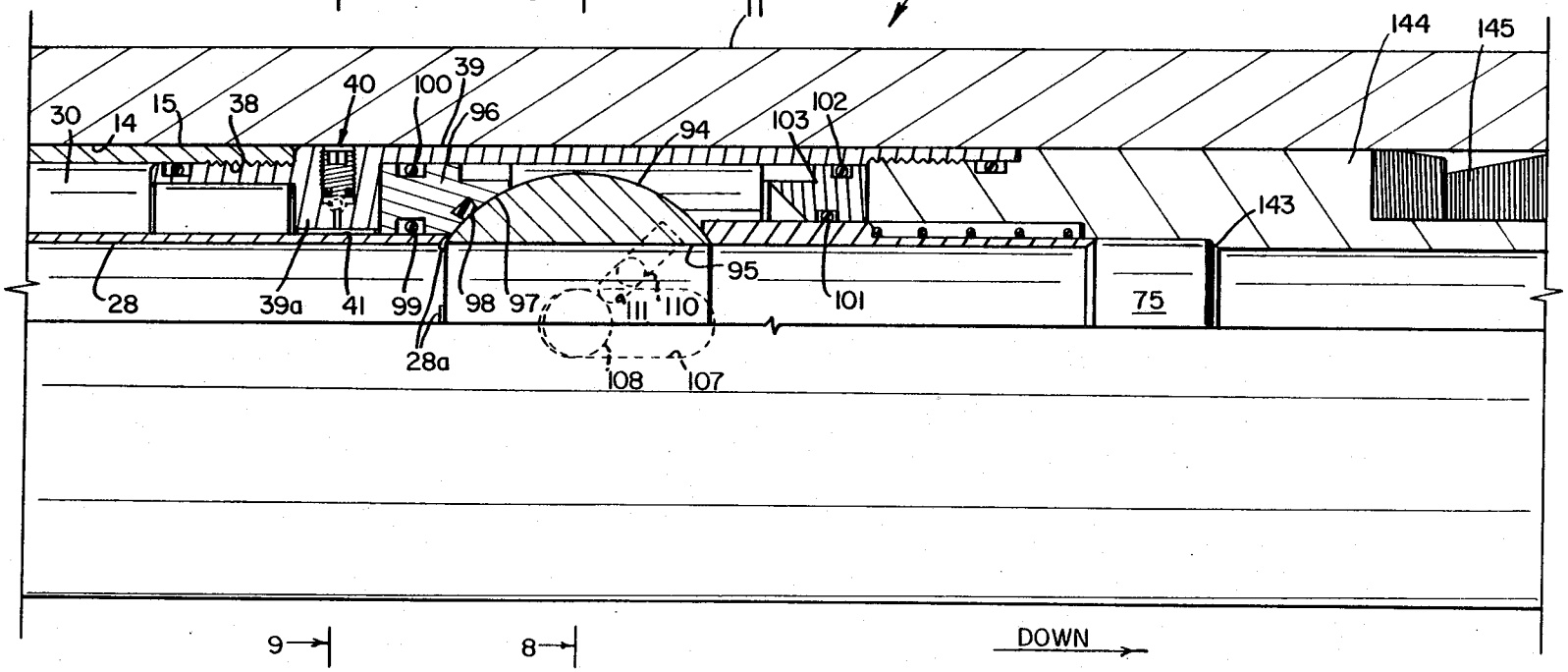
FIG. 6 is a partial quarter section showing a portion of the apparatus below that shown in FIG. 5.
Figure 7:
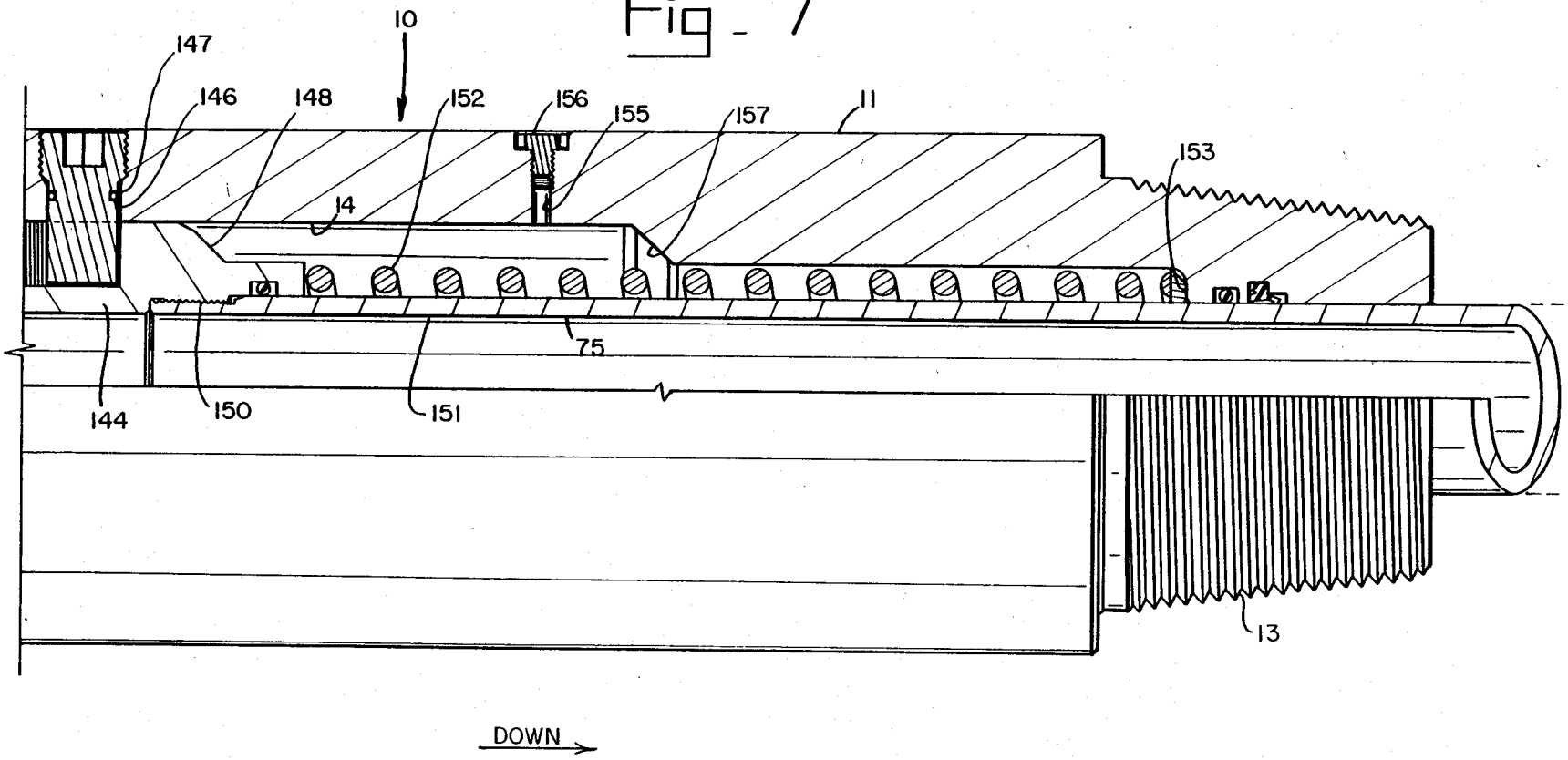
FIG. 7 is a partial vertical quarter section showing a portion of the equipment below the portion shown in FIG. 6.
Figure 9:
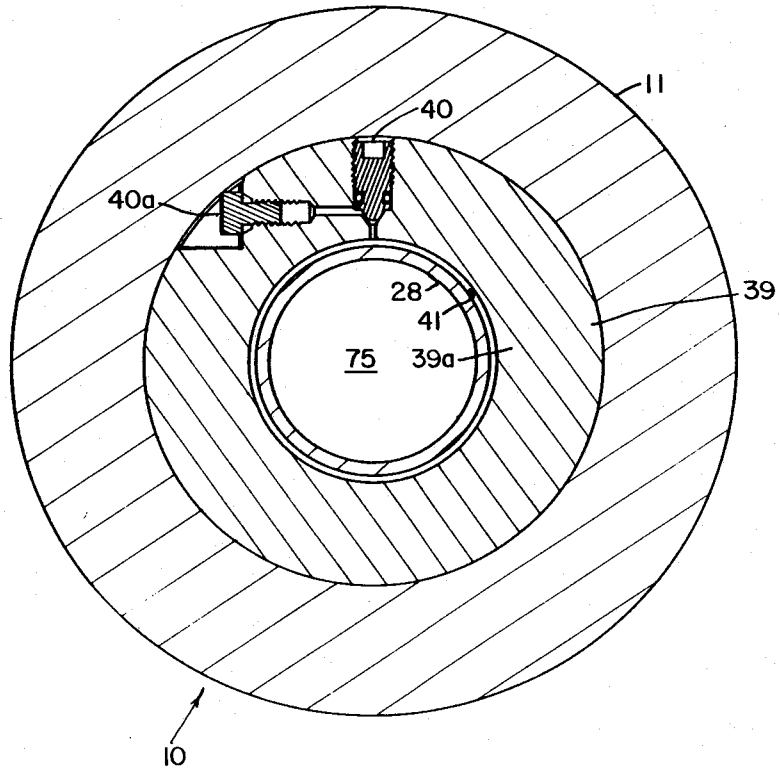
FIG. 9 is a transverse cross section taken at line 9—9 of FIG. 6.
Figure 10:
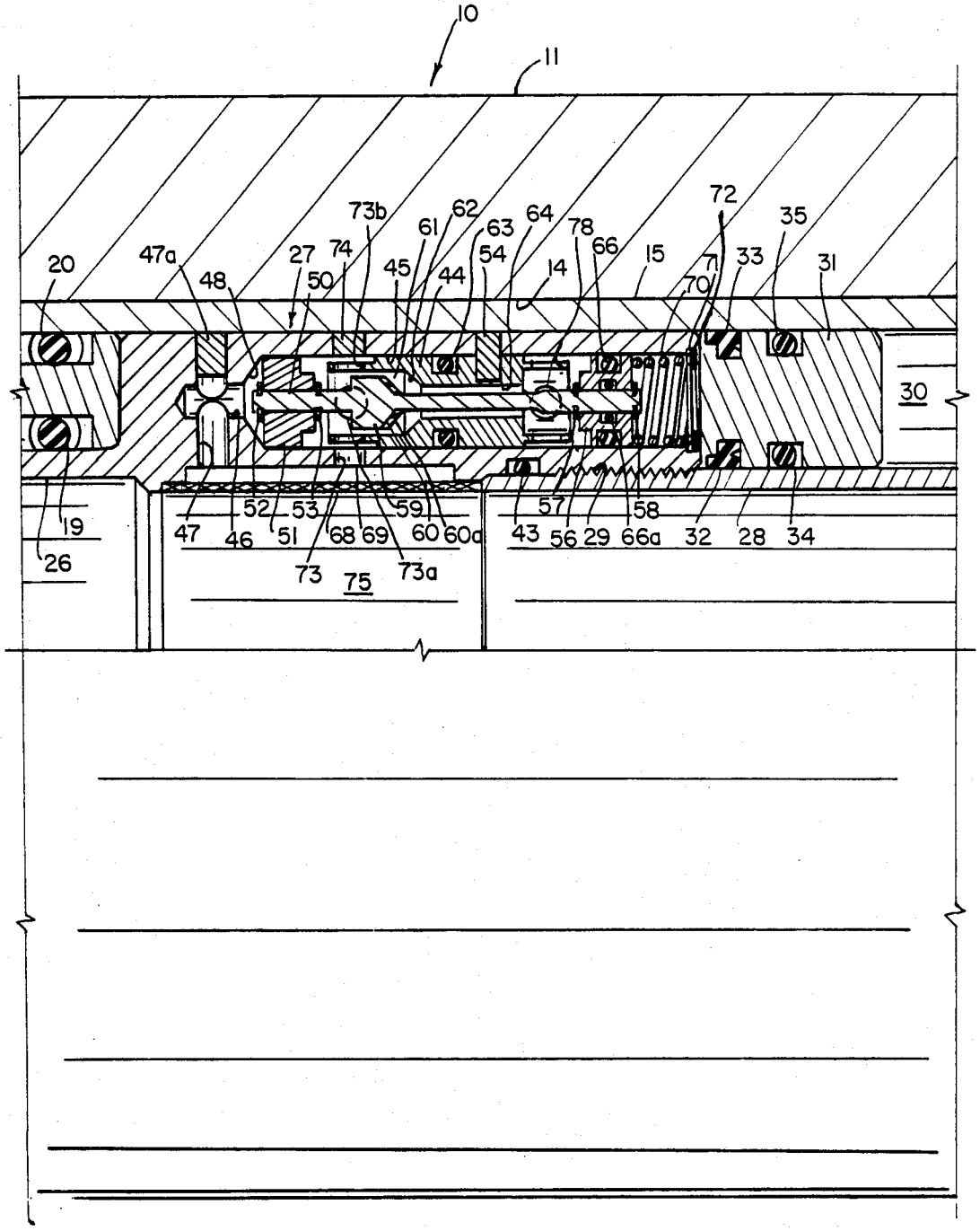
FIG. 10 is a cross section taken as FIG. 5A, showing a larger portion of the apparatus.

Referring now to the drawings in detail, and first to FIGS. 5–7, the apparatus 10 includes an outer housing body 11 which is tubular in shape. Housing body 11 includes an upper internally threaded socket or box 12, and a lower threaded pin 13. Housing body 11 has a passageway 14 of varying diameters therethrough from top to bottom. An inner mandrel 15 of elongated tubular shape is fitted within passage 14 and has upper interior threads 16 into which inner mandrel cap 17 is screwed. Inner mandrel cap 17 is tubular in form, having upset upper portion **17*a* which fits closely within passage 14 and has inner and outer O-ring seals 19, 20 therearound. An upper mandrel element 21 has short outwardly facing conical surface 22 which engages a cooperating conical surface around the wall of passage 14. Mandrel 21 has lower outwardly reduced portion 23 which fits spacedly within portion 17***a* of cap 17. Portion 23 of mandrel 21 has inner seal 24 and O-ring seal 25 to seal with thin walled portion 26 of a tubular valve housing 27. The valve housing is tubular in form, as is its upper thin walled portion 26. A piston tube 28 is screwed at its outer threads 29 to corresponding threads at the lower interior of valve housing 27. An annular accumulator space 30 is provided in the annulus formed between inner mandrel 15 and piston tube 28. An annular floating isolator piston 31 is disposed below valve housing 27 in accumulator space 30, and has therearound inner and outer seals 32, 33 and O-ring seals 34, 35. The seals 32–35 are preferably of a low friction type so that piston 31 may be moved freely along the accumualtor space under low pressure differentials. Inner mandrel 15 has, at its lower end, internal thread formation 38 to which is screwed a ball housing 39. In inwardly thickened portion 39*a* of ball housing 39 there is provided a gas charging valve 40 having lateral branch 40*a* (see also FIGS. 9 and 10) through which an inert gas such as nitrogen may be introduced into accumulator space 30, the gas passing through the annular space 41 between formation 39*a* and piston tube 28. Valve housing 27 has around its interior an O-ring seal 43. A valve body 44 is slidably disposed through a cylindrical opening 45 partway through body 27. At the left hand end of passage 45, there is a short passage 46 of decreased diameter and a cross passage 47 which intersects passage 46 at its center. A conical shoulder 48 is provided between passage 45 and passage 46. A valve stem 50 is received at one end through a piston 51 and fixed thereto by snap rings 52, 53. Valve body 44 is fixed in place in passage 45 by a shear pin 54. At its opposite lower end, stem 50 has a second piston 56 fixed thereto by snap rings 57, 58. Stem 50 has an enlarged valve formation 59 (see FIGS. 5A and 10) having conical end 60 within a chamber 61 in body 44. Chamber 61 has conical seat end 62. Valve formation 59 seats at its surface 60 against surface 62, there being a layer of sealing material 60*a* on surface 60. O-ring seal 63 is provided around valve body 44. Stem 50 extends with clearance through a passage 64 through body 44. Piston 56 has therearound outer and inner O-ring seals 66, 66*a*.

A cylindrical screen 68 is disposed between the lower end of housing portion 26 and the upper end of piston tube 28, as shown, housing 27 having an interior recess 69 therearound at the location of the screen. A helical compression spring 70 is disposed between perforated washer 71 and the end of piston 56, as shown, washer 71 being supported by a snap ring 72.

Passage 47 is plugged at 47*a* opposite recess 69, and passage 73 is plugged at its end 74. When pressured fluid from passage 75 enters through screen 68 into passage 47, the pressure acts on the lefthand (FIGS. 5,5A,10) side of piston 51. Accumulator 30 pressure acts on the righthand side of piston 56. Piston 51 is balanced because of fluid pressure from passage 75 entering to the righthand side of piston 51 through port 73. Spring 70 urges the entire piston assembly toward the left. Pressure from passage 75 also passes through port 73, chamber 61 and annulus 64 to act on the lefthand side of piston 56. When the differential pressure of passage 75 is increased slowly, as by slow operation of pumps 116 (FIG. 3), the pressure enters the accumulator 30 through passages 78 without causing sufficient differential pressure to develop across piston 56 to cause piston formation 59 to be moved to the right to seat surface 60 at seat 62. However, when the pressure in passage 75 is increased rapidly, as by fast operation of pumps 116 (FIG. 3), then sufficient differential pressure will be developed across piston 56 to overcome the force of spring 70 and to cause surface 60 to seat at seat 62 to shut off flow of the pressured fluid to the accumulator 30.

For this reason, the valve assembly is termed a "fuse", because it will permit a flow under relatively lower pressure differential conditions, but will close when the differential pressure (between inlet and outlet) exceeds a certain pressure level. The elevation of pressure at which the fuse closes is controlled by the compression resistance of spring 70 and this can be made of any desired value.

Fluid flowing past piston 59 through passage 64 outflows through passages 78. Flow through passages 78 is to check valve assembly 79 having a ball valve 80, a spring 81, a seat 82 having a sealing layer 83 and a seat opening 84. Flow through opening 84 depresses the ball valve against the bias of spring 81 and permits flow through passage 85 into accumulator space 30. Flow through passage 78 is blocked at plug 86. Fluid cannot flow in the reverse direction from accumulator space 30 into passage 78 because of check valve 79.

As an alternative embodiment of the apparatus, check valve 79 may be replaced by a pressure relief type valve 44*a*. The pressure relief type valve 44*a* would then act as a check valve with a non-zero opening pressure. In addition, this alternative arrangement permits building a bias between the tool bore and the accumulator space 30. Such a bias can serve to overcome frictional drag from piston seals and other non-ideal restraints. A variable orifice (not shown) can be located on the charging branch on the accumulator side of the fuse 44 and pressure relief valve 44*a*, and this orifice can be adjusted to compensate for a varying performance of pumps 116 (shown in FIG. 3).

Figure 2:
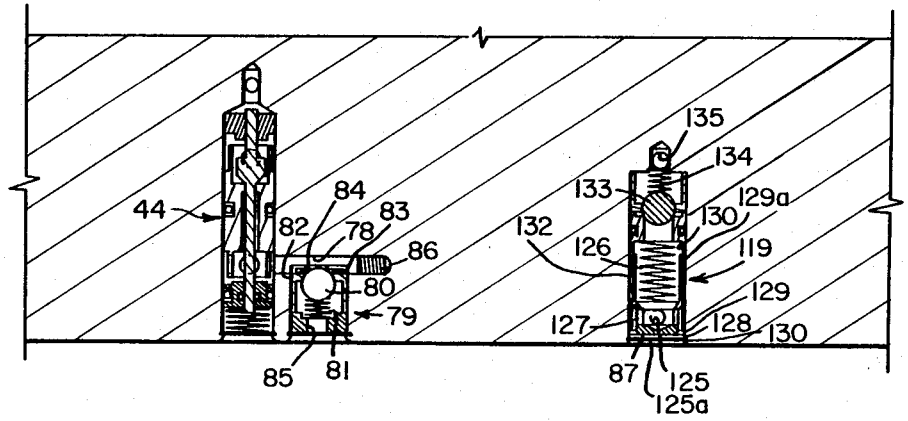
FIG. 2 is a vertical cross section taken at arcuate line 2—2 of FIG. 1.
Figure 1:
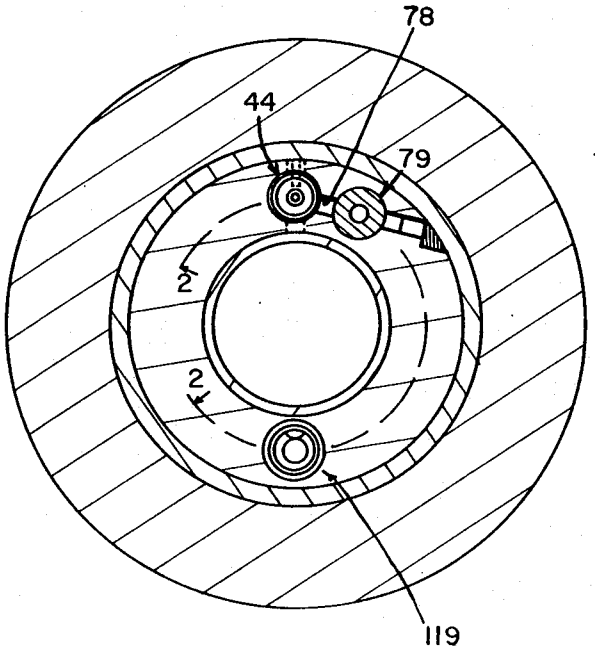
FIG. 1 is a transverse cross section taken at line 1—1 of FIG. 5.
Figure 12:
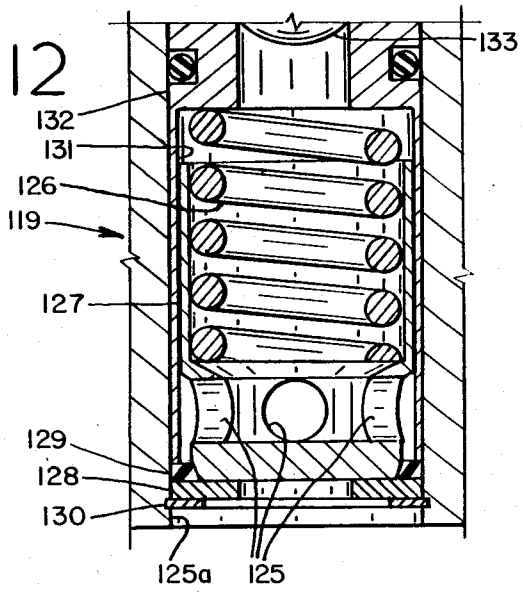
FIG. 12 is a partial enlarged vertical cross section of a portion of the apparatus.

Referring to FIGS. 1, 2, and 12, a pressure relief valve 119 is shown. Passages 125 of valve 119 are in communication with the accumulator space 30 through end opening 125*a*. Spring 126 biases valve poppet 127 toward closed position against seat ring 128 having seal ring 129 thereabove. The seat ring 128 is held in place by a snap ring 130, as best shown in FIG. 12. Spring 126 is disposed in a passage space 131 within the body 132 of valve 119. When the biasing pressure of spring 126 is overcome, valve 127 unseats from seat 128 and flow can pass upwardly through valve 119, [as shown in FIG. 2.] A ball check valve 133 biased by compression spring 134 prevents backflow from passage 75 into the accumulator. By choosing the compression strength of spring 126, flow from the accumulator to passage 75 will not occur unless a predetermined pressure differential exists. Passage 135 communicates with passage 75, for flow of fluid from the accumulator back into passage 75. Passage 125*a*, of course, communicates with the interior of accumulator space 30.

Farther down within passage 14 of the outer body 11, there is provided the ball housing 39, which serves as a support for a ball valve 94. Ball valve 94 has a flow passage 95 therethrough which is of the same diameter as passage 75. Ball housing 39 has therein a seat body 96 having a spherical seat 97 against which the exterior of ball valve 94 is normally disposed in an open condition. A seal 98 is provided at the seat surface. A pair of O-ring seals 99, 100 are disposed inwardly and outwardly around the upper end of member 96. A pair of O-ring seals 101, 102 are disposed around the interior and exterior of lower member 103. At the lower end of piston tube 28 where it contacts ball 94, there are provided a plurality (usually four to eight) of the rectangular notches 28*a*, allowing fluid in passage 75 to leak to between ball valve 94 and seat body 96, so that when the ball valve is closed, fluid will leak past the ball valve and the fluid hammer described elsewhere is reduced. The ball valve 94 does not seat against the upper side of member 103 when closed so the leak fluid can pass on down past the ball, the ball being slightly displaced from seat member 96.

Figure 8:
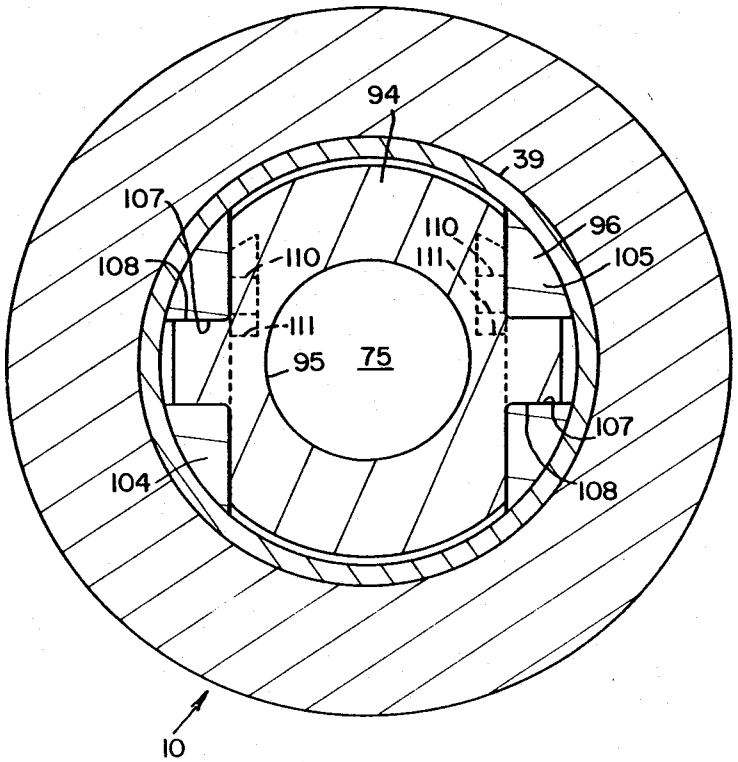
FIG. 8 is a transverse cross section taken at line 8—8 of FIG. 6.

Referring now to FIG. 8 of the drawings, a pair of slide elements 104, 105 are disposed one at each side of the ball, each having an opening 107 to receive a diametrically opposed pins 108*a, b* at the sides of the ball and about which the ball rotates. Each element 104, 105 has a pin 110 which operates in a slot 111 in a face of the ball to cause rotation of the ball when the ball supporting elements are moved upwardly and downwardly. For a complete description of the operation a ball valve 94, reference is made to U.S. Pat. No. 4,415,027, which contains such description. Valve 94 is shown in FIG. 6 in open condition. The valve 94 is moved to closed condition by downward movement thereof. Whenever tool bore pressure in passage 75 exceeds accumulator pressure, the annular piston comprising the differential area of valve housing upper portion 26 and piston tube 28 is stroked downwardly. This stroke will cause ball 94 to rotate and partially close so that it serves as further flow restriction to passage 75, thereby amplifying the force on the inner mandrel 15 and transmitting a detectable water hammer pulse to the surface to indicate tool function. Maintaining the resulting force on inner mandrel 15 permits performing work, as exemplified in my pending U.S. patent application Ser. No. 06/368,993, filed Apr. 16, 1982 and now U.S. Pat. No. 4,596,294, issued June 24, 1986 and entitled Surface Controlled Bent Sub for Directional Drilling of Petroleum Wells.

Figure 3:
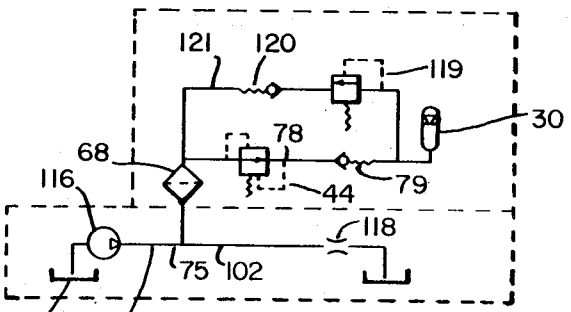
FIG. 3 is a schematic flow diagram showing one embodiment of the valve system according to the invention.

Referring now to schematic FIG. 3 of the drawings, a supply of drilling mud at the well surface is represented by symbolic element 115. Drilling mud is pumped by one or more rig pumps 116 through the drill string 117, a portion of which is formed by passage 75. The lower drill string 102 continues on down to a drill bit, the bit nozzles of which are indicated symbolically by reference number 118. Portions of the drill string, of course, are connected to the apparatus herein disclosed at internally threaded box 12 and at threaded pin 13. The valve 44 shown in FIG. 5 is indicated by its reference numeral in FIG. 3, same being described as a fuse for the reasons given. Check valve 79 is shown in FIG. 3, with suitable flow lines connecting filter 68, fuse 44, and check valve 79 and a flow line to the accumulator 30. The return flow from the accumulator to passage 75 is indicated by flow lines leading to a pressure relief valve 119 and a check valve 120. Flow therefrom passes through flow passage 121 back through filter 68 into passageway 75.

Figure 4:
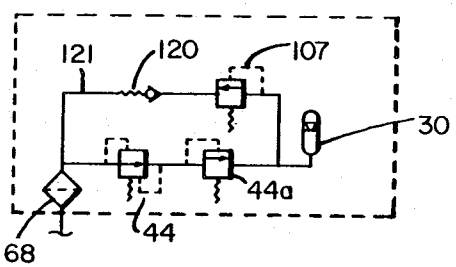
FIG. 4 is a schematic flow diagram showing a modified form of flow diagram according to the invention.

Referring to FIG. 4 of the drawings, a portion of the same flow assembly as shown in FIG. 3 is shown, except that a relief valve, mentioned earlier and referred to by reference numeral 44*a*, is substituted for check valve 79, as earlier described.

Figure 11:
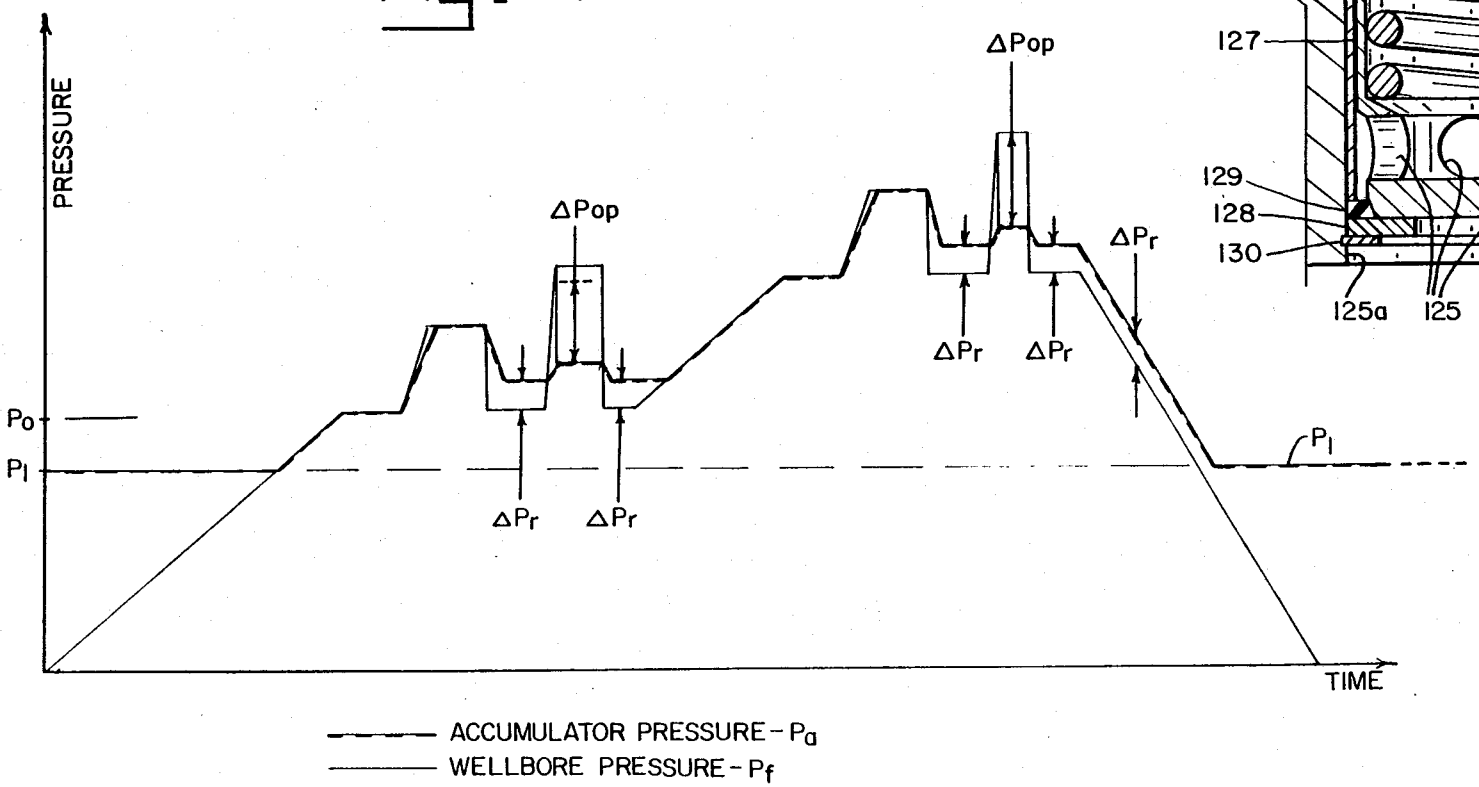
FIG. 11 is a schematic graph showing pressure charges versus time during operation of the apparatus according to the invention.

Referring to the system shown in FIG. 3, and also referring to FIG. 11, and noting $\Delta P_r$, $\Delta P_{op}$, P, and $P_o$ indicated thereon, the operational sequence of adjusting the accumulator charge and operating the tool will be described. The downhole hydrostatic pressure at the least depth of desired tool actuation is known to be approximately $P_o$. The accumulator 30 is precharged at the surface with nitrogen (through valve 40, shown in FIG. 9) to an initial pressure $P_1$, less than $P_o$. Thus $P_1 < P_0$. As the tool is lowered into the hole, the void areas in the valving and flow passages will be filled with drilling fluid moving from drillstring flow passage 75 through cylindrical screen 68. The floating isolator piston 15 is not displaced until the pressure in the flow passage 75, $P_f$, exceeds $P_1$. Normally the pressure $P_f$ in the flow passage builds smoothly and relatively slowly as the drillstring is lowered. Typically some amount of fluid enters the control valving 44 and 79 to displace the isolator piston 15 and substantially balance the accumulator pressure, $P_a$, with the external pressure $P_f$ before reaching the least operating depth (lowest required trigger pressure).

When the rig pump 116 is started slowly, the hydraulic fuse 44 does not experience sufficient differential pressure between $P_f$ and $P_a$ to cause it to close. Thus, there is one-way communication into the accumulator 30 through the fuse 44 and check valve 79. In the meantime, check valve 120 remains seated, against the contrary pressure gradient, blocking flow through the accumulator exhaust passage 121. Therefore, when the pump starts slowly, the accumulator pressure $P_a$ will substantially equalize to $P_f$, i.e., $P_a \nearrow P_f$. If the pump 116 is stopped, or slowed, pressure $P_f$ will reduce. Pump stoppage causes $P_f$ to be equal to the hydrostatic head at the tool depth. In the event that $P_a - \Delta P_r > P_f$, where $\Delta P_r$ is the pressure differential that causes relief valve 119 and check valve 120 to open, the accumulator will exhaust fluid through return passage 121 into the main flow passage 75 until $P_a - \Delta P_r = P_f$. Henceforth, if the hydrostatic pressure is unchanged and the pump 116 pressure does not exceed $\Delta P_r$, the pump may be started rapidly without risk of triggering closure of fuse 44.

If the tool is raised in the well so that the pressure $P_f$ is reduced, the accumulator will tend to relieve pressure by flow through the relief valve 119 and check valve 120 as long as $P_a - \Delta P_r > P_f$. If the tool is lowered in the well or the pump pressure is slowly raised so $P_f - P_a < P_{Fuse}$, where $P_{Fuse}$ is the closure pressure differential for the fuse 44, then the accumulator will tend to balance to pressure $P_f$ by admitting flow through fuse 44 and check valve 79.

In order to operate the tool 10, it is necessary to build sufficient bias between $P_f$ and $P_a$, $\Delta P_{op}$ is the pressure, differential required to cause the piston tube 28 and coacting components 26 and 27 stroke downwardly to operate the ball 94. Tool operation will occur if $P_f - P_a > \Delta P_{op}$. Such a pressure differential can be obtained by speeding up pump 116 sufficiently or using other techniques in order to rapidly raise pressure $P_f$ without permitting equalization of accumulator pressure $P_a$ to $P_f$. Rapid building of $P_f$ in excess of $P_a$ causes fuse 44 to close, thus fully isolating the accumulator. After sufficient time has been allowed for performing "work" of the type described in my pending U.S. patent application Ser. No. 06/368,993 now U.S. Pat. No. 4,596,294, the excess pressure $P_f$ may be reduced, permitting return of piston tube 28. While a pressure differential $P_f - P_a > \Delta P_{op}$ could be obtained by replacing fuse 44 with a restrictive orifice, such a system would lead to eventual reduction of the differential pressure below $\Delta P_{op}$.

This system readily permits adjustment of accumulator pressures for increasing hydrostatic pressures, even with large ratios of maximum $P_f/P_o$, by simple, straightforward pump manipulations.

Referring to FIG. 4, the two systems (FIG. 3 and FIG. 4) are structurally similar except for substitution of relief valve 44*a* for check valve 79. Such a system behaves identically to the system of FIG. 3 except that an additional bias pressure equal to the opening (relief) pressure of valve 44*a*, $\Delta P_x$, must be overcome to admit flow into the accumulator 30. In this case, $P_{a4}$ is the accumulator pressure. Then $P_{a4}=P_a-\Delta P_x$, where $P_a$ is the accumulator pressure of the system of FIG. 3, may be substituted in the pressure relationship described for the other case. Such a bias has a variety of uses. For instance, the bias may be used to overcome high seal frictions or help compensate for low pump performances.

It should be noted that this method of accumulator charging could be adapted to respond to annular pressures or other sources. Further, the accumulator pressure charging circuit need not be the same source of the pump side component of the differential pressure between the pump side and the accumulator side of the control piston.

A snap ring 122 retains element 21 against upward movement in passage 14.

Below the ball valve 94 assembly, passage 75 has an upwardly facing conical shoulder 143 which limits downward movement of the ball valve assembly. A spring-engaging element 144 at the lower end of the ball valve assembly has a slot 145, the slot engaging a pin 146 screwed into a tapped opening through the outer body and sealed therearound by an O-ring seal 147. Member 144 has a lower conical shoulder 148. Member 144 has lower interior threads 150 to which is screwed a tubing 151 which continues on down to lower level operator assemblies, adapted to perform "work" attached below tool 10. A helical compression spring 152 engages between a shoulder 153 in the outer housing and the lower end of member 144. A lubrication port 155 closable by plug 156 permits lubrication of the lower interior elements of the assembly. The outer body has an interior upwardly facing shoulder 157 which may be engaged by surface 148. Restrictive annular flow passages between the bore 14 of body 11 and the outer surfaces of elements 144, 39, 15 provides damping to cushion downward motion of the mandrel, etc.

It will be understood that the accumulator 30 pressure may be used for operation of other apparatuses than the ball valve 94. It will additionally be clear that an apparatus for accumulator pressure control has been disclosed which may be operated over a definite pressure range within the drill string to control the accumulator pressure to any desired level, and that additional apparatus may be operated by drill string pressure outside of the accumulator actuating range to do other operations in the well. It will be realized that the apparatus herein disclosed is simple in operation, safe, and readily understood by operators of the well.

While preferred embodiments of the apparatus according to the invention have been described and shown in the drawings, many modifications thereof may be made by a person skilled in the art without departing from the spirit of the invention, and it is intended to protect by Letter Patent all forms of the invention falling within the scope of the following claims.

I claim:

1. A downhole tool, including a charging apparatus for an accumulator, for use in a well, said apparatus being adapted to automatically compensate for ambient pressure changes due to varying hydrostatic pressure gradients in said well, comprising means including a normally-open fuse valve means for admitting pressured fluid from a central well pipe into an accumulator space in response to a pressure differential in a first preselected differential pressure range between said central well pipe and said accumulator space, means including a relief valve means for discharging pressured fluid from said accumulator space into said central well pipe in response to a pressure differential in a second preselected differential pressure range between said accumulator space and said central well pipe, means at the surface for varying the fluid pressure in said central well pipe, whereby by varying the fluid pressure in said central well pipe at the surface, pressured fluid from said central well pipe may be admitted to and discharged from said accumulator space as desired to alter the fluid pressure within said accumulator space.

2. The combination of claim 1, said accumulator space being disposed annularly about said central well pipe.

3. The combination of claim 1, said fuse-valve means closing to stop pressured fluid flow admission into said accumulator space when said first pre-selected pressure range is exceeded, and said relief valve means closing to stop pressured fluid flow discharge from said accumulator space when said second pre-selected differential pressure range is exceeded, whereby fluid pressures in said central well pipe not resulting in either of said first and second pre-selected differential pressure ranges may be utilized for other operations of procedures downhole in the well.

4. The combination of claim 3, at least one of said fuse valve and relief valve means having a check valve means in serial flow therewith to prevent reverse flow to said fluid flow admission and said fluid flow discharge therethrough, respectively.

5. The combination of claim 1, including screen means between said central well pipe and each of said fuse and relief valve means.

6. The combination of claim 5, said screen means being a single screen means.

7. The combination of claim 1, said accumulator space being a vertically elongate uniform annular space, there being a movable isolation means dividing said accumulator space into two variable volume spaces, and including lower valve means communicating between the exterior of said apparatus and one of said spaces through which a fluid may be precharged into said one of said spaces before said apparatus is run into a well, said fuse valve means and said relief valve means each being in flow communication with the other of said spaces.

8. The combination of claim 7, said movable isolation means comprising a slidable annular piston.

9. The combination of claim 7, said piston having low-friction inner and outer seals therearound whereby said piston is movable to equalize pressures in said upper and lower spaces by small differential pressures therebetween.

10. The combination of claim 3, including:

a ball valve assembly characterized by open and closed configurations;

a piston tube operatively interconnecting said fuse valve means with said ball valve assembly, said piston tube defining a wall between said accumulator space and said central well bore, said piston tube being responsive to actuate said ball valve assembly to the closed configuration when said first differential pressure range is exceeded.

11. The combination of claim 10, including:

a longitudinal housing body;

a mandrel, slidably mounted longitudinally within housing body, said mandrel being coupled to said ball valve assembly so that when said ball valve is actuated to the closed configuration, said mandrel moves to execute a stroke to perform desired work.

12. The combination of claim 11, including:

means for fluidly damping movement of said mandrel.

13. The combination of claim 12, including:

means for providing a controlled leak when said ball valve is actuated to the closed configuration, thereby to inhibit water hammer.

14. The combination of claim 3, including:

means, operatively associated with said fuse valve means, for establishing a bias pressure differential reducing the upper limit of said first differential pressure range to compensate for frictional losses when said piston tube actuates said ball valve assembly.

* * * * *